US011806851B2

(12) United States Patent
Strazza

(10) Patent No.: US 11,806,851 B2
(45) Date of Patent: Nov. 7, 2023

(54) MULTICONFIGURATIONAL SUPPORT TOOL

(71) Applicant: Thomas Strazza, Glenwood Springs, CO (US)

(72) Inventor: Thomas Strazza, Glenwood Springs, CO (US)

( * ) Notice: Subject to any disclaimer, the term of this patent is extended or adjusted under 35 U.S.C. 154(b) by 0 days.

(21) Appl. No.: 17/961,052

(22) Filed: Oct. 6, 2022

(65) Prior Publication Data

US 2023/0115649 A1 Apr. 13, 2023

Related U.S. Application Data

(60) Provisional application No. 63/254,032, filed on Oct. 8, 2021.

(51) Int. Cl.

| | |
|---|---|
| ***B25B 5/14*** | (2006.01) |
| *B25B 5/00* | (2006.01) |
| *B25B 5/06* | (2006.01) |

(52) U.S. Cl.

CPC ..... *B25B 5/147* (2013.01)

(58) Field of Classification Search

CPC .. B25B 5/147; B25B 5/00; B25B 5/06; G04D 1/06

See application file for complete search history.

(56) References Cited

U.S. PATENT DOCUMENTS

| | | | | |
|---|---|---|---|---|
| 15,427 | A | | 7/1856 | Langwith |
| 432,829 | A | | 7/1890 | Hirst |
| 568,543 | A | | 9/1896 | Parks |
| 576,758 | A | * | 2/1897 | Griffin ..... B25B 5/006 269/100 |
| 817,513 | A | | 4/1906 | Parker |
| 912,187 | A | | 2/1909 | Senn |
| 1,054,246 | A | | 2/1913 | Stauffer |
| 1,381,663 | A | | 6/1921 | Roeder |
| 1,390,189 | A | | 9/1921 | Bixler |
| 2,786,434 | A | * | 3/1957 | Klungtvedt ..... B25B 1/2478 269/96 |
| 2,991,070 | A | * | 7/1961 | Overton ..... H01Q 1/1228 269/45 |
| 3,659,452 | A | * | 5/1972 | Atwood ..... G01N 21/1702 374/54 |
| 3,659,482 | A | | 5/1972 | Blake |
| 3,981,491 | A | | 9/1976 | Snyder |
| 3,981,494 | A | * | 9/1976 | Prestegaard ..... B65H 3/0858 271/99 |
| 4,058,302 | A | * | 11/1977 | Barrowcliff ..... B25B 5/006 269/97 |
| 5,312,096 | A | | 5/1994 | Jasper |

(Continued)

*Primary Examiner* — Bayan Salone

(74) *Attorney, Agent, or Firm* — Leyendecker & Lemire, LLC

(57) ABSTRACT

A multiconfigurational support tool is described. Embodiments of the multiconfigurational support tool can include, but are not limited to, a main member, a first support member, and a second support member. The first support member and the second support member can each be removably coupled to the main member such that the support members can be rotated and moved along a length of the main member as determined by a user. The first support member can be implemented to interface with a first object and the second support member can be implemented to interface with a second object.

20 Claims, 6 Drawing Sheets

(56) References Cited

U.S. PATENT DOCUMENTS

| | | | | |
|---|---|---|---|---|
| 9,737,064 | B2 * | 8/2017 | Durrant | B62C 5/00 |
| 9,778,011 | B1 | 10/2017 | Armstrong | |
| 9,778,014 | B2 * | 10/2017 | Hoglund | G01B 7/003 |
| 2014/0209649 | A1 | 7/2014 | Schuster | |
| 2015/0102189 | A1 * | 4/2015 | Klamm | F16M 11/40 248/176.3 |

* cited by examiner

MULTICONFIGURATIONAL SUPPORT TOOL

CROSS-REFERENCE TO RELATED APPLICATION

This application claims the benefit of U.S. Provisional Application No. 63/254,032, filed Oct. 8, 2021.

BACKGROUND

In the heating, ventilation, and air conditioning (HVAC) industry along with the plumbing industry, pipe repairs are common. Depending on a specific repair, two workers may be needed to complete the repair. Typically, one worker can focus on the repairs (e.g., sweating, brazing, welding, etc.) while the other worker can support the pipes being worked on. This often leads to increased costs as two workers are needed for a single job.

A device that can be implemented by a single worker to support various objects being worked on is needed.

DETAILED DESCRIPTION

Figure 1:
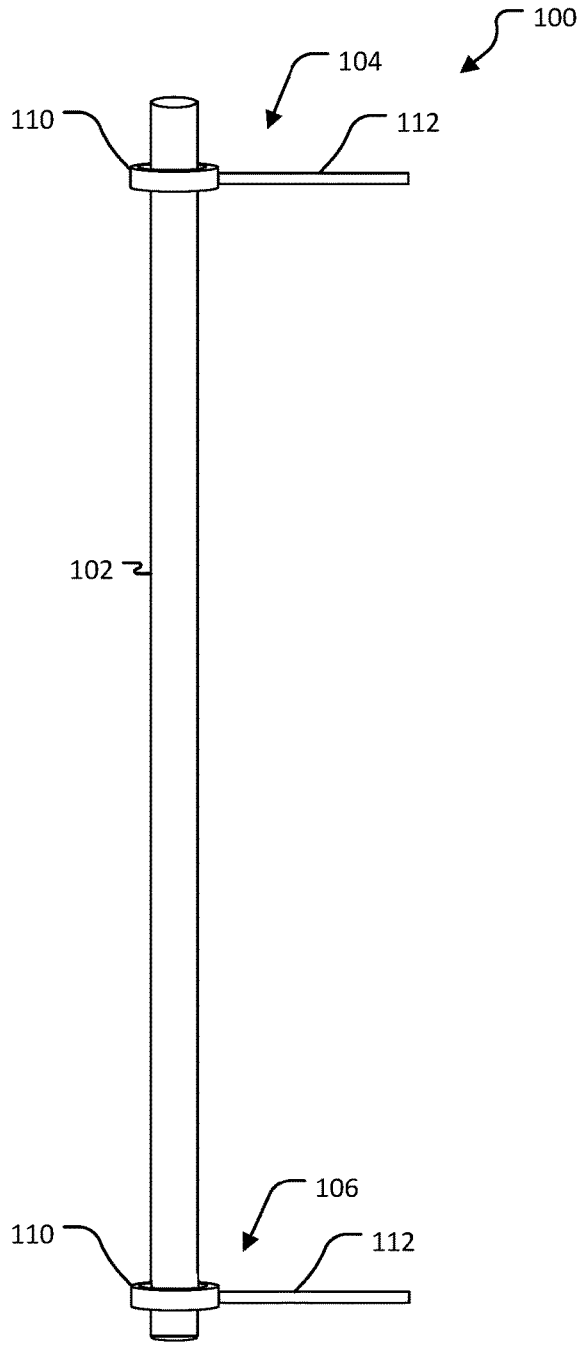
FIG. 1 is a side view of a multiconfigurational support tool according to one embodiment of the present invention.

Embodiments of the present invention include a multiconfigurational support tool that can be implemented in the plumbing/HVAC industry. Of note, the multiconfigurational support tool can be implemented in other industries as would be apparent from the detailed description. The multiconfigurational support tool can be used to support an object being worked on to allow a user to have a free hand in lieu of supporting the object with their hand. The support tool can be leaned on, can hang from an object to support another object, and can keep objects separated. Generally, the support tool can be implemented by a solo worker to help where another worker would be needed.

In one embodiment, the multiconfigurational support tool can include, but is not limited to, a main member, a first support member, and a second support member. The main member can generally be a bar of rigid material having a substantially circular cross-section. The first support member and the second support member can be configured to move along an entire length of the main member and rotate completely about the main member. For instance, the first support member and the second support member can each move along a length of the main member and rotate 360 degrees around the main member and then be locked in place as determined by the user. In some embodiments, a magnetic base plate that can couple to the main member can be provided. In some instances, the first support member and the second support member can be provided without the main member. As can be appreciated, this may allow a user to implement an already available object as the main member.

The first support member and the second support member can each include a means for moveably and rotatably coupling to the main member. In one example, modified shaft collars can be implemented to secure the first support member and the second support member to the main member. The modified shaft collars can include a protrusion extending out radially from the shaft collar. The protrusion can be implemented to interface with objects. In one example, the protrusion can be integral to the shaft collar. In another instance, the protrusion can be removably coupled to the shaft collar.

In one example, the main member can be a rigid bar having a circular cross-section. Of note, a length of the main member can be based on a particular need or can be changed (e.g, extended). In some instances, the first support member and the second support member can be implemented with a plurality of differently sized bars. In one example, the first support member and the second support member can each be coupled to the main member via a clamp. In some instances, the first support member may have a different means for coupling to the main member than the second support member.

Typically, protrusions of the first support member and the second support member can be configured to extend perpendicular to a longitudinal axis of the main member. In some instances, one of the support members may include a clamp or magnet for securing an object thereto. In some instances, one of the support members may have a hook shape (or "J" shape) such that the multiconfigurational support tool can be hung from the hook shaped support member. As previously mentioned, the first support member and the second support member can each be rotatably and moveably coupled to the main member. As can be appreciated, this can allow for the support members to be placed in a variety of different configurations based on a need of a user.

In one embodiment, the main member can include at least one threaded end to allow for a second bar to be removably coupled to the first main member. In one instance, a first end of the main member can include male threading and a second end of the main member can include female threading. As can be appreciated, the threaded ends can allow for additional bars to be coupled to the main member. Of note, the threaded end of the main member can be configured to receive an accessory thereon. For instance, a hook having a threaded end can be mated with one of the threaded ends of the main member to provide a hook on the end of the main member. The multiconfigurational support tool may then be hung from the hook coupled to the main member. It is to be appreciated that other accessories are contemplated to be threadably coupled to the main member.

In some instances, the support tool can be configured to sit on top of an object (e.g., a bucket) with the first support member engaging the object and the second support member engaging a pipe. Generally, when the support tool is placed on a flat surface, the first support member (or second support member) can be moved to an end of the main member and the second support member (or first support member) can be moved to engage the pipe needing to be supported. As can be appreciated, with the support member located proximate an end of the main member, the support tool can be able to support the pipe in-place.

As previously mentioned, the multiconfigurational support tool can include a magnetic base plate that can be coupled to the main member proximate one end of the bar. Of note, the magnetic base plate can allow the support tool to be free standing. This can allow for the first support member and the second support member to each support an object with the support tool stabilized by the magnetic base plate. In some instances, the magnetic base plate can couple to a ferromagnetic material. For example, an HVAC piece of equipment may be ferromagnetic allowing for the magnetic base plate to couple to the piece of equipment.

In a typical implementation, the multiconfigurational support tool can be configured to support a pipe while a user may be free to use both hands. As is generally known, a user would need to have a helper to hold a pipe steady while brazing/sweating the pipe pieces together. The multiconfigurational support tool can allow the user to have both hands free by supporting a pipe being worked on.

In one example implementation, the multiconfigurational support tool can be located between two objects. More specifically, the support tool can engage a heater with the first support member and support a pipe with the second support member. Of note, the support tool can be used in a variety of situations since the support members can move and rotate along a length of the main member. In such an instance, the first support member can be protruding out in a first direction and the second support member can be protruding out in a second, different direction.

In another example implementation, the multiconfigurational support tool can be implemented to support a pipe being cut. Of note, the first support member can be located underneath the pipe being cut while the second support member can be located on top of a second pipe. As can be appreciated, by placing the second support member on top of the second pipe, the weight of the first pipe can be supported since the first support member is located underneath the first pipe. The support tool can be implemented to provide support to a pipe in various configurations allowing the multiconfigurational support tool to be used in a variety of different scenarios.

In yet another example implementation, the support tool can be used to support pipes that are located near a ceiling. As can be appreciated, it may be difficult to get a flat surface near a pipe located proximate a ceiling to provide a solid base for support. As such, one of the support members can effectively hang the support tool from a pipe. Of significant note, this can allow the support tool to be used at elevated locations where a typical means for support may not be available. For instance, the user may need to work on the pipe while using a ladder. The multiconfigurational support tool can allow the user to use both hands while working from a ladder by providing support to the pipe being worked on.

In one embodiment, the multiconfigurational support tool can include, but is not limited to, a main member having a pair of moveable and rotatable support arms extending out perpendicularly to the main member. The pair of support arms can move along a length of the main member and can rotate fully around the rod allowing for the support arms to be oriented as needed by a user. The pair of support arms can generally be rigid rods. In some instances, one of the support arms may include a means for securing an object thereto. For example, the support arm may include a magnetic portion for magnetically coupling to an object. In another example, the support arm may include a clamp for securing the support arm to an object. The multiconfigurational support tool may further include a magnetic base plate that can be coupled to an end of the main member.

In one example, a support tool can include, but is not limited to, a rigid member, a first support member, and a second support member. The first support member can be removably coupled to the rigid member and can be defined by (i) a shaft collar, (ii) a protrusion radially extending from the shaft collar, and (iii) being able to move along an entire length of the rigid member and rotate about the rigid member. The second support member can be removably coupled to the rigid member and can be defined by (i) a shaft collar, (ii) a protrusion radially extending from the shaft collar, and (iii) being able to move along an entire length of the rigid member and rotate about the rigid member.

In another example, a support tool can include, but is not limited to, a rigid bar, a first support member, and a second support member. The rigid bar can have a substantially circular cross-section. The first support member can be removably coupled to the rigid bar and can be able to move along an entire length of the rigid bar and rotate about the rigid bar when in a loosened configuration. The second support member can be removably coupled to the rigid bar and can be able to move along an entire length of the rigid bar and rotate about the rigid bar when in a loosened configuration. The first support member and the second support member can each include an engagement member. The first support member and the second support member can each be defined by (i) a shaft collar sized to receive the rigid bar, and (ii) the engagement member being integral to the shaft collar.

In yet another example, a support tool can include, but is not limited to, a rigid member, a first support member, and a second support member. The rigid member can have a substantially circular cross-section. The first support member and the second support member can each be removably coupled to the rigid member. The first support member can be defined by (i) a shaft collar sized to receive the rigid bar, and (ii) an engagement member (a) radially extending from the shaft collar, and (b) being integral to the shaft collar. The second support member can be defined by (i) a shaft collar sized to receive the rigid bar, and (ii) an engagement member slidably coupled to the shaft collar.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment", "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

A First Embodiment of a Multiconfigurational Support Tool

Figure 2:
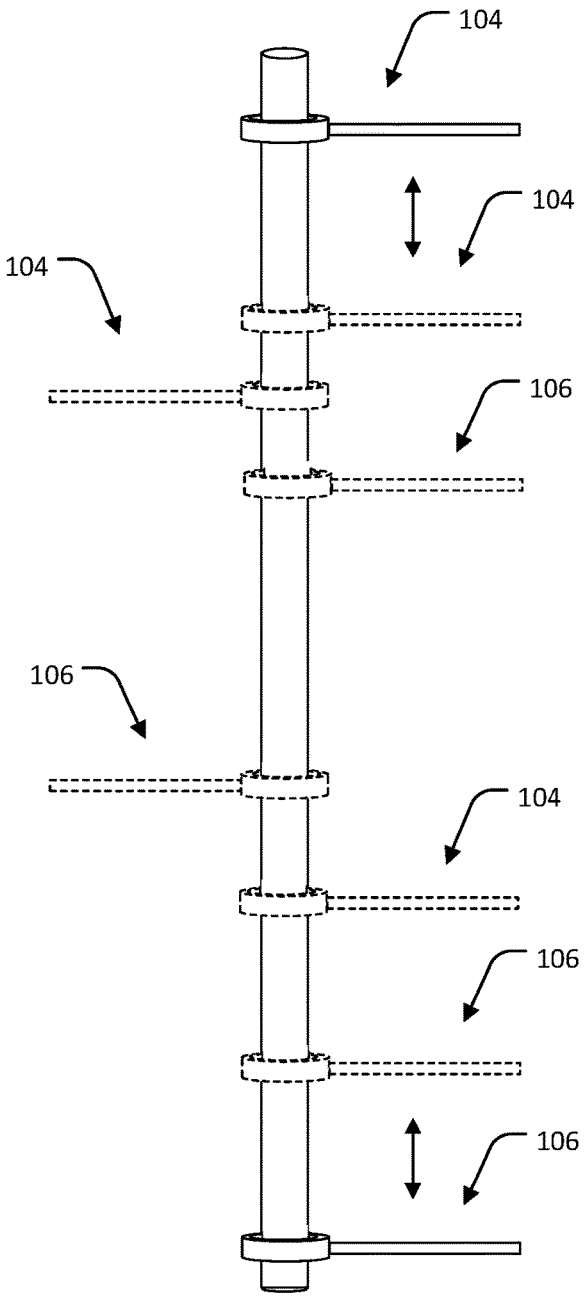
FIG. 2 is a side view of a multiconfigurational support tool according to one embodiment of the present invention.

Referring to FIGS. 1-2, detailed diagrams of a first embodiment 100 of a multiconfigurational support tool are illustrated. The first embodiment multiconfigurational support tool (hereinafter "tool" or "support tool") 100 can be implemented as an extra pair of hands for use by a solo worker. Typically, the tool 100 can be used to support an object allowing a user to have a free hand that would otherwise be supporting the object.

As generally shown in FIG. 1, the tool 100 can include, but is not limited to, a main member 102, a first support member 104, and a second support member 106. Of note, embodiments are contemplated where more than two support members are implemented as part of the tool 100. Typically, the first support member 104 can be substantially similar to the second support member 106. In some instances, the first support member 104 can include different features than the second support member 106. For instance, the first support member 104 may include a clamp.

The main member 102 can generally be a rigid (or semi-rigid) cylindrical bar (or tube) having a substantially circular cross-section. For instance, round bar can be implemented as the main member 102. Generally, a length and a diameter of the main member 102 can vary without exceeding as scope of the present invention. In some instances, the tool 100 can have a relatively small main member 102. In other instances, the tool 100 can have a relatively large main member 102. As can be appreciated, a size of the main member 102 can be variable depending on a specific implementation. In one example, the main member 102 can be an iron bar having a substantially circular cross-section. In another example, the main member 102 can be a steel tube having a substantially circular cross-section. Of note, embodiments are contemplated where the main member 102 has a square cross-section or other shaped cross-sections.

The support members 104/106 can each include a coupling 110 and an engagement member 112. The coupling 110 can be configured to removably couple to the main member 102. The engagement member 112 can extend out perpendicularly to a longitudinal axis of the main member 102 when the coupling 110 is coupled to the main member 102. In some instances, the engagement member 112 can be a protrusion radially extending from the coupling 110. The protrusion may be integral to the coupling 110 in some instances and can be removably coupled in other instances. When the coupling 110 is loosened, the support members 104/106 can be configured to rotate about the main member 102 and move along an entire length of the main member 102. As can be appreciated, this can allow a user to configure the support tool 100 as needed. For example, a distance between the two support members 104/106 can be adjusted along with a rotational location of the support members 104/106 to each other. In some instances, one of the support members 104/106 can be located on an end of the main member 102 to act as a base for the support tool 100 to stand by itself.

Referring to FIG. 2, the support tool 100 and a movement of the support members 104/106 is illustrated. As shown, the support members 104/106 can move along an entire length of the main member 102. Typically, the coupling 110 of the support members 104/106 can be configured to couple to the main member 102 such that the coupling can be loosened to allow the support members 104/106 to move and rotate around the main member 102. When the support member 104/106 is located where a user decides, the coupling 110 can be tightened and the support member 104/106 can be locked in place.

Figure 3:
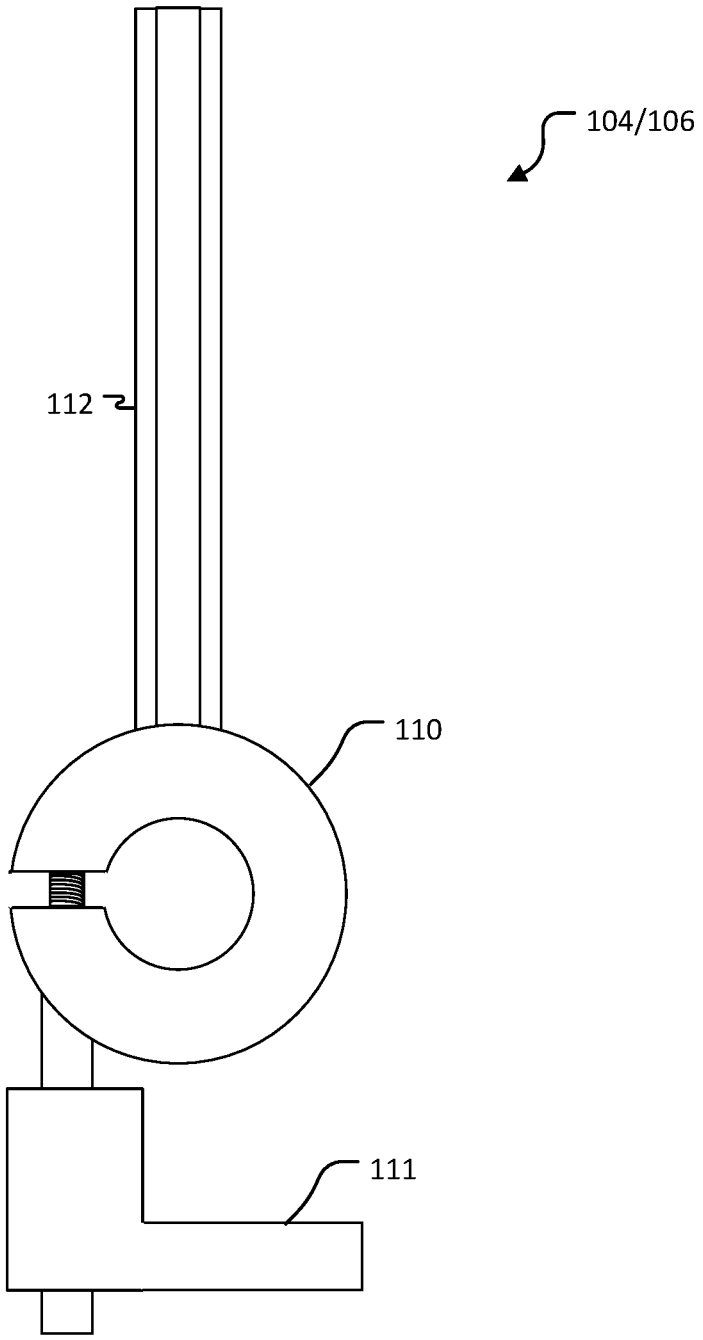
FIG. 3 is a top view of a support member according to one embodiment of the present invention.

Referring to FIGS. 3, a detailed diagram of one example embodiment of a support member 104/106 is illustrated. FIG. 3 includes a top view of the support member 104/106. As shown, the coupling 110 can be a shaft collar. A rigid bar can be implemented as the engagement member 112. Of note, a shaft collar can rotatably and moveably couple to a tube or round bar. The shaft collar 110 can include a lever 111 to allow a user to quickly and easily tighten and/or loosen the shaft collar 110. In some embodiments, a quick-release mechanism can be implemented in place of the lever. Of note, a bore of the shaft collar 110 can be sized to receive the main member 102 therethrough. As can be appreciated, the shaft collar 110 can be tightened to secure to the main member 102. When a user wants to move the support member 104/106, the user can loosen the shaft collar 110 to move and/or rotate the support member 104/106 to a preferred location. In some instances, the engagement member 112 may have a hexagonal cross-section. In other instances, the engagement member 112 may have a square cross-section. In yet other instances, the engagement member 112 may have a rectangular cross-section.

A Second Embodiment of a Multiconfigurational Support Tool

Figure 4:
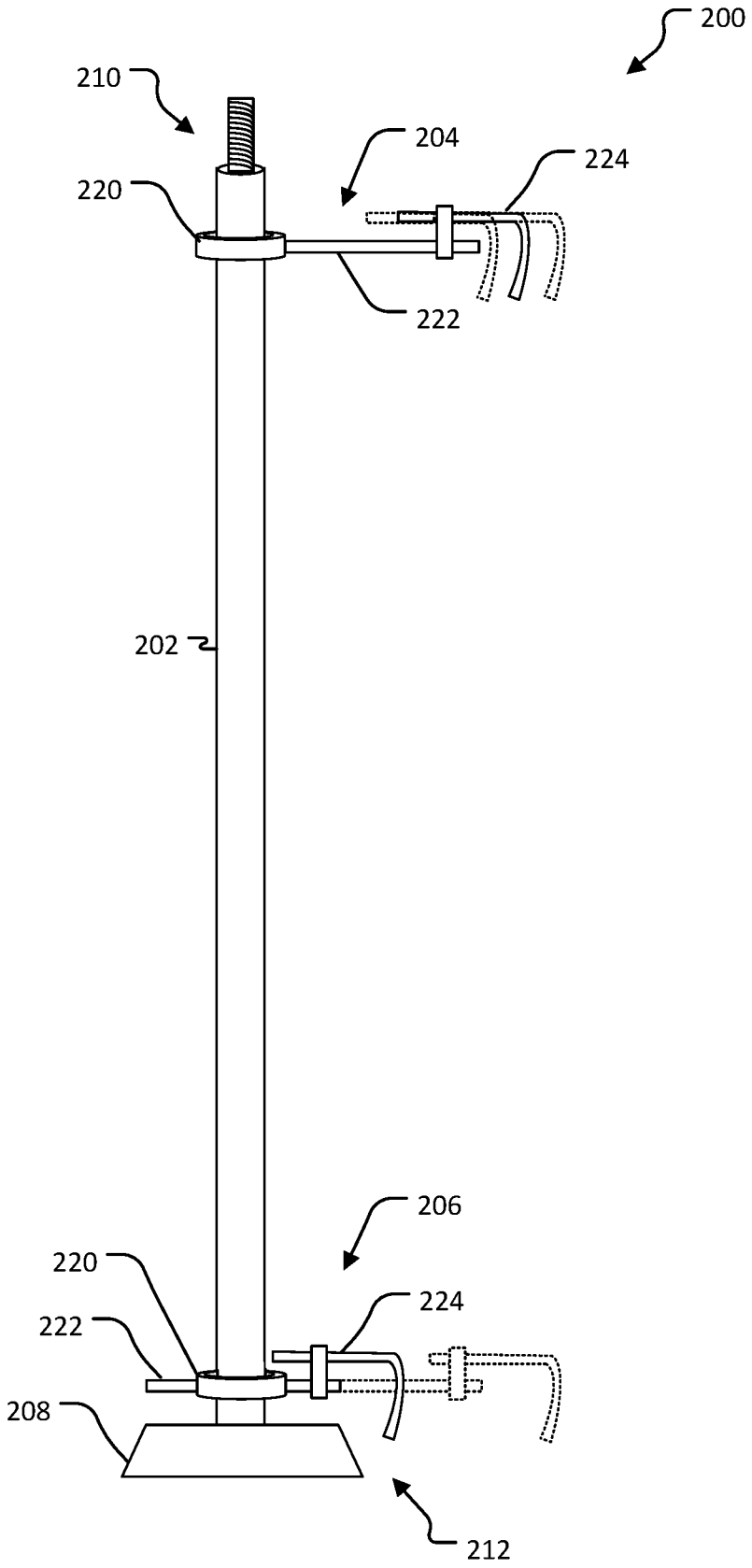
FIG. 4 is a side view of a multiconfigurational support tool according to one embodiment of the present invention.

Referring to FIG. 4, a detailed diagram of a second embodiment 200 of a multiconfigurational support tool are illustrated. The second embodiment multiconfigurational support tool (hereinafter tool) 200 can be implemented similarly to the first embodiment tool 100.

As shown in FIG. 4, the second embodiment tool 200 can include, but is not limited to, a main member 202, a first support member 204, a second support member 206, and a base member 208.

The main member 202 can typically be a rigid bar including a first end 210 being threaded and a second end 212 including a threaded receptacle. As can be appreciated, the first end 210 can be configured to mate with a second end 212 of a second main member. This can allow for more than one main member to be implemented. In one instance, a first main member may have a first length and a second main member may have a second length. In some instances, an accessory can be configured to threadably couple to the first end 210 of the main member 202. For example, a hook may threadably couple to the first end 210 such that the tool 200 can be hung from an object.

The support members 204, 206 can each include, but are not limited to, a coupling 220, an engagement member 222, and a clamp 224. The coupling 220 can be implemented to couple the support members 204, 206 to the main member 202. Typically, the coupling 220 can be quickly loosened and tightened to allow a user to position the support members 204, 206 where they would like along a length of the main member 202. Similar to the first embodiment couplings 110, the second embodiment couplings 210 can be rotated around the main member 202 when not tightened allowing for the engagement members 222 to be placed where a user may need. The engagement members 222 may be slidably coupled to the coupling 220 allowing for the engagement members 222 to be moved back and forth relative to the coupling 220. Typically, the engagement members 222 can be locked in place when a user has the engagement members 222 in a preferred location. The clamp 224 can be removably coupled to the engagement member 222.

The base member 208 can be implemented to provide a stable support for the support tool 200 to standalone. In general, the base member 208 can be implemented where the support tool 200 can be placed on a flat surface and one or more of the support members 204, 206 can be implemented to engage and support an object. In other instances, the base member 208 can be magnetic such that the base member 208 can be magnetically coupled to an object. For instance, a ferromagnetic steel cover of an HVAC component. As can be appreciated, this may allow for the support tool 200 to be oriented horizontally with the base member 208 magnetically coupled to an object. In on example, the base member 208 may include a threaded protrusion configured to mate with the threaded receptacle of the second end 212 of the main member 202. In another example, the base member 208 may include a receptacle sized to receive and frictionally engage the second end 212 of the main member 202. It is to be appreciated that other means of removably coupling the base member 208 to the main member 202 are contemplated and not outside a scope of the present invention.

Figure 5:
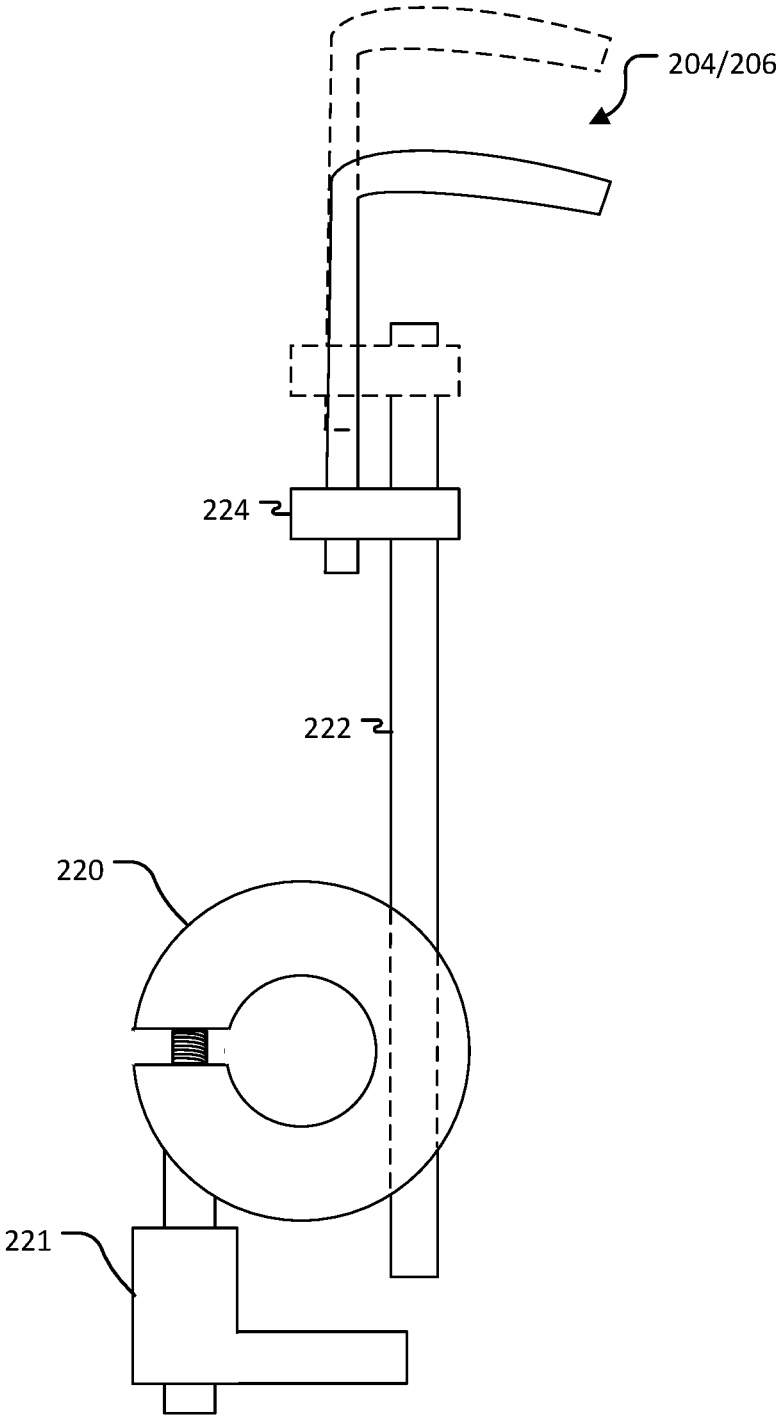
FIG. 5 is a top view of a support member according to one embodiment of the present invention.

Referring to FIG. 5, a top view of the support member 204/206 is illustrated. As shown, the engagement member 222 can pass partially through the coupling 220. Similar to the first embodiment coupling 110, the second embodiment coupling 220 can include a lever 221 to allow a user to quickly and easily tighten and/or loosen the coupling 220 to the main member 202. As will be shown in FIGS. 6A-6C, the coupling 220 can include a second lever 230 for securing the engagement member 222 in place. In some instances, the clamp 224 can be locked in place. In other instances, as shown, the clamp 224 can be configured to move along a length of the engagement member 222.

Figure 6A:
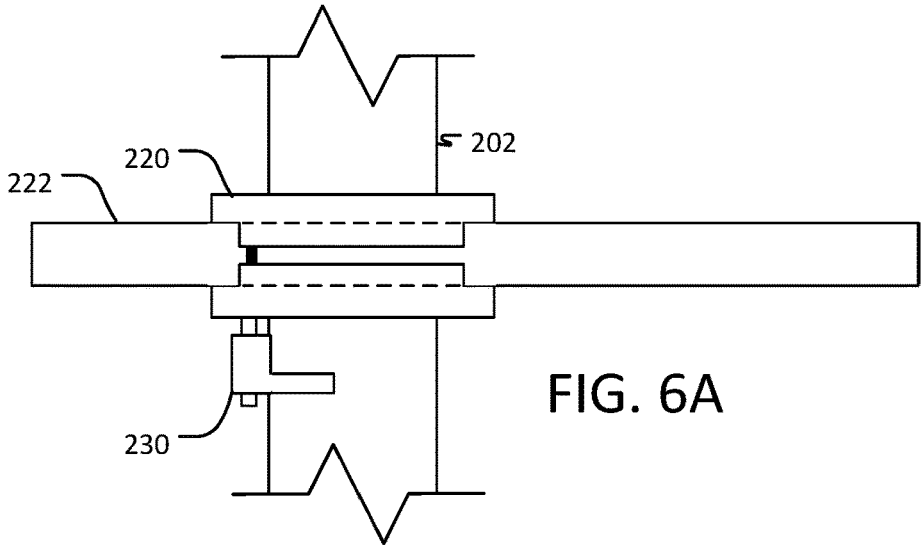
FIGS. 6A-6C are side views of a support member according to one embodiment of the present invention.
Figure 6B:
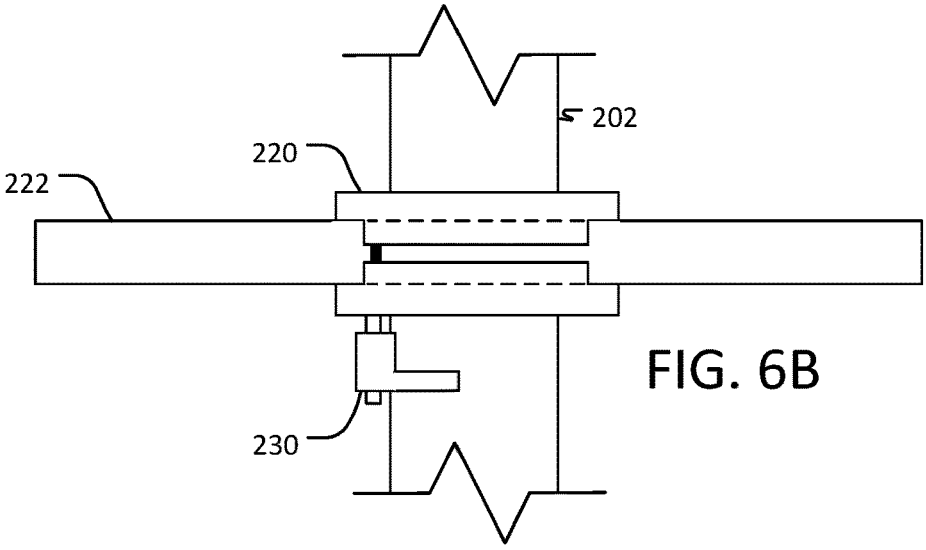
Figure 6C:
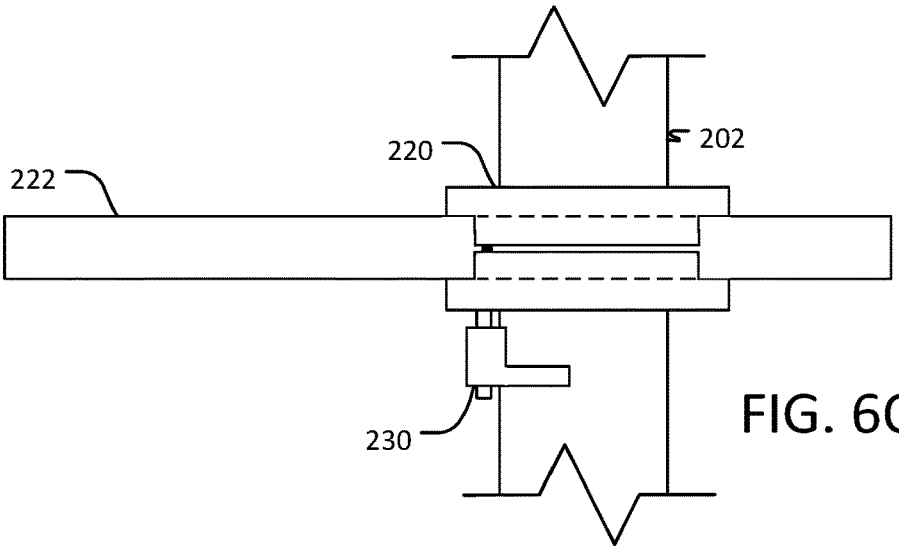

Referring to FIGS. 6A-6C, side views of the support member 204/206 are illustrated. Of note, the clamp 224 is not included. More specifically, the engagement member 222 is shown moving through the coupling 220 to various different positions. In one embodiment, the coupling 220 can include the second lever 230 for quickly loosening and tightening the engagement member 222 to the coupling 220. The coupling 220 can include a slot (not explicitly shown) for receiving the engagement member 222 therethrough. Of note, FIG. 6C illustrates a narrow gap between the slot in the coupling 220 indicating that the lever 230 has been implemented to tighten the engagement member 222 in place.

An Embodiment of a Multiconfigurational Support Tool Kit

Figure 7:
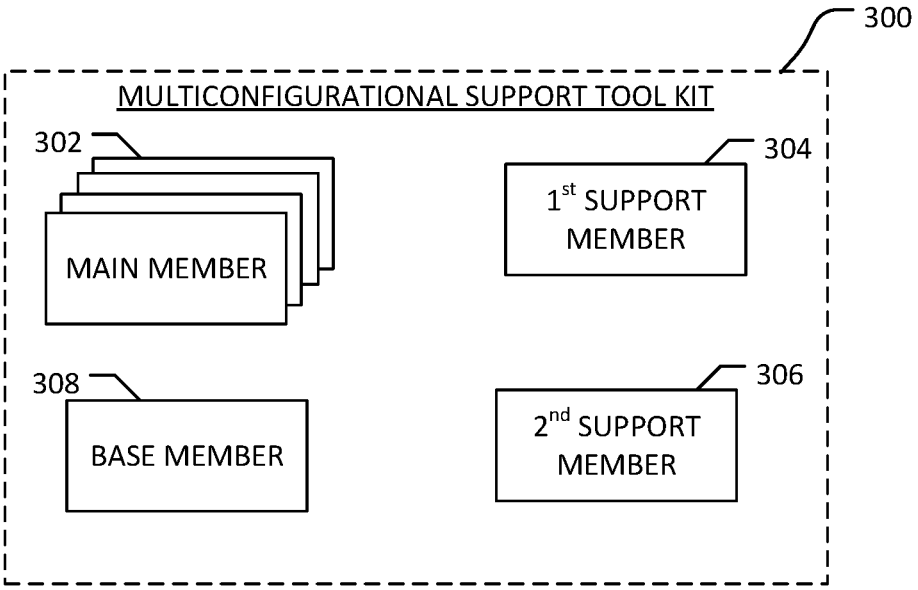
FIG. 7 is a block diagram of a multiconfigurational support tool kit according to one embodiment of the present invention.

Referring to FIG. 7, a block diagram of an embodiment 300 of a multiconfigurational support tool kit is illustrated. The kit 300 can be implemented to provide a modular and configurable support tool having a plurality of different components and configurations.

As shown, the kit 300 can include, but is not limited to, one or more rigid members 302, one or more first support members 304, one or more second support members 306, a base member 308, and various combinations thereof. Typically, at least one rigid member 302, a pair of the first embodiment support members 304 or a pair of the second embodiment support members 306, and the base member 308 can be included in the kit. In some instances, one first embodiment support member 304 and one second embodiment support member 306 may be included.

The one or more rigid members 302 can include embodiments substantially similar to the first embodiment main member 102 and/or the second embodiment main member 202. The first support members 304 can be substantially similar to the first embodiment support members 104/106. The second support members 306 can be substantially similar to the second embodiment support members 204/206. The base member 308 can be substantially similar to the previously described base member 208.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention. Embodiments are contemplated where one of the support members is fixed in place to the main member.

I claim:

1. A support tool comprising:

a rigid member;

a first support member removably coupled to the rigid member, the first support member being defined by (i) a shaft collar, (ii) a protrusion radially extending from the shaft collar, and (iii) being able to move along an entire length of the rigid member and rotate about the rigid member; and a second support member removably coupled to the rigid member, the second support member being defined by (i) a shaft collar, (ii) a protrusion radially extending from the shaft collar, and (iii) being able to move along an entire length of the rigid member and rotate about the rigid member.

2. The support tool of claim 1, wherein the rigid member is a round bar.

3. The support tool of claim 2, wherein a first end of the round bar includes male threads and a second end of the round bar includes a receptacle having female threads.

4. The support tool of claim 1, wherein the rigid member is a bar having a substantially circular cross-section.

5. The support tool of claim 1, wherein the first support member protrusion extends out perpendicular to a longitudinal axis of the rigid member when the first support member is coupled to the rigid member.

6. The support tool of claim 1, further including:

at least one additional rigid member having a first end having male threads and a second end including a receptacle having female threads.

7. The support tool of claim 6, wherein the rigid member is coupled to the at least one additional rigid member.

8. The support tool of claim 7, wherein the first support member and the second support member are each adapted to move along an entire length of the rigid member and the at least one rigid member.

9. The support tool of claim 1, further including a base member removably coupled to the rigid member.

10. A support tool comprising:

a rigid bar having a substantially circular cross-section;

a first support member removably coupled to the rigid bar, the first support member being able to move along an entire length of the rigid bar and rotate about the rigid bar when in a loosened configuration; and a second support member removably coupled to the rigid bar, the second support member being able to move along an entire length of the rigid bar and rotate about the rigid bar when in a loosened configuration;

wherein the first support member and the second support member each (i) include an engagement member; and (ii) are adapted to be operatively coupled to the rigid bar anywhere along an entire length of the rigid bar.

11. The support tool of claim 10, wherein the first support member and the second support member are each defined by (i) a shaft collar sized to receive the rigid bar, and (ii) the engagement member being integral to the shaft collar.

12. The support tool of claim 11, wherein the first support member is further defined by the engagement member radially extending from the shaft collar.

13. The support tool of claim 10, wherein the first support member is defined by a shaft collar including a slot for interfacing with the engagement member.

14. The support tool of claim 13, wherein the engagement member is slidably engaged to the slot.

15. The support tool of claim 10, wherein the engagement member of the first support member is adapted to engage a first object and the engagement member of the second support member is adapted to engage a second object.

16. A support tool comprising:

a rigid member having a substantially circular cross-section;

a first support member removably coupled to the rigid member, the first support member being defined by (i) a shaft collar sized to receive the rigid bar, and (ii) an engagement member (a) radially extending from the shaft collar, and (b) being integral to the shaft collar; and a second support member removably coupled to the rigid member, the second support member being defined by (i) a shaft collar sized to receive the rigid bar, and (ii) an engagement member slidably coupled to the shaft collar.

17. The support tool of claim 16, wherein the rigid member is a solid bar.

18. The support tool of claim 16, wherein the rigid member is a hollow cylinder.

19. The support tool of claim 16, the support tool further including:

a second rigid member defined by a first end having male threads and a second end having a female threaded receptacle.

20. The support tool of claim 19, wherein the rigid member is adapted to mate with the second rigid member.

* * * * *